US011255150B2

(12) United States Patent
Alarfaj et al.

(10) Patent No.: US 11,255,150 B2
(45) Date of Patent: Feb. 22, 2022

(54) COLLECTING JUNK IN A WELLBORE

(71) Applicant: Saudi Arabian Oil Company, Dhahran (SA)

(72) Inventors: Abdullrohman Khaled Alarfaj, Dammam (SA); Talal Issa Al-Hadi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/885,119

(22) Filed: May 27, 2020

(65) Prior Publication Data

US 2021/0372214 A1 Dec. 2, 2021

(51) Int. Cl.

| | |
|---|---|
| ***E21B 27/00*** | (2006.01) |
| ***E21B 17/10*** | (2006.01) |
| *E21B 43/12* | (2006.01) |

(52) U.S. Cl.
CPC ..... *E21B 27/005* (2013.01); *E21B 17/1078* (2013.01); *E21B 43/128* (2013.01)

(58) Field of Classification Search
CPC ..... E21B 27/00; E21B 27/005; E21B 31/00; E21B 31/08
See application file for complete search history.

(56) References Cited

U.S. PATENT DOCUMENTS

| | | | | |
|---|---|---|---|---|
| 3,385,368 | A * | 5/1968 | Solum | E21B 33/136 277/335 |
| 7,753,113 | B1 | 7/2010 | Penisson | |
| 8,453,724 | B2 | 6/2013 | Zhou | |
| 9,416,626 | B2 | 8/2016 | Xu et al. | |
| 2005/0072571 | A1 | 4/2005 | Penisson | |
| 2012/0118571 | A1 | 5/2012 | Zhou | |
| 2016/0333668 | A1* | 11/2016 | Xu | E21B 27/005 |
| 2016/0362954 | A1* | 12/2016 | Hansen | E21B 27/005 |
| 2018/0266201 | A1* | 9/2018 | Baudoin | E21B 7/18 |
| 2019/0309768 | A1* | 10/2019 | Todd | F04D 29/426 |

FOREIGN PATENT DOCUMENTS

| | | |
|---|---|---|
| AU | 2010201076 | 11/2011 |

OTHER PUBLICATIONS

PCT International Search Report and Written Opinion in International Appln. No. PCT/US2021/033836, dated Jul. 19, 2021, 13 pages.

* cited by examiner

*Primary Examiner* — David Carroll
(74) *Attorney, Agent, or Firm* — Fish & Richardson P.C.

(57) ABSTRACT

A wellbore assembly includes a production string disposed inside a wellbore and a junk collector coupled to a downhole end of the production string. The junk collector has an upper rim defining an opening configured to receive wellbore junk. The junk collector receives wellbore junk through the upper rim at a downhole end of the production string and stores the wellbore junk.

13 Claims, 5 Drawing Sheets

COLLECTING JUNK IN A WELLBORE

FIELD OF THE DISCLOSURE

This disclosure relates to wellbores, in particular, to wellbore production assemblies.

BACKGROUND OF THE DISCLOSURE

During wellbore procedures, some components such as bands, clamps, and rubber can fall off the production string. Such components can form piles of junk in the wellbore that interfere with wellbore equipment and production during intervention or other post-completion procedures. Methods and equipment for collecting and removing such components are sought.

SUMMARY

Implementations of the present disclosure include a wellbore assembly that includes a production string disposed inside a wellbore. The production string flows production fluid from a downhole location within the wellbore to a surface of the wellbore. The wellbore assembly also includes a junk collector coupled to a downhole end of the production string. The junk collector has an upper rim defining an opening configured to receive wellbore junk. The junk collector receives wellbore junk through the upper rim at a downhole end of the production string and stores the wellbore junk.

In some implementations, the junk collector includes a first tube fluidically coupled to the production string. The first tube flows the production fluid to the production string. The junk collector also includes a second tube coupled to and disposed outside the first tube. The second tube includes the upper rim and a tubular wall extending from the upper rim. The second tube has an interior volume defined between an exterior surface of the first tube and an interior surface of the tubular wall of the second tube. The interior volume stores the wellbore junk. In some implementations, the second tube has a downhole end that defines an inwardly projecting shoulder extending from the interior surface. The shoulder supports the wellbore junk. In some implementations, the inwardly projecting shoulder has or is a magnet configured to attract at least some components of the wellbore junk. In some implementations, at least 50% of an area of the inwardly projecting shoulder includes a magnet, and the inwardly projecting shoulder defines apertures fluidically coupling the interior volume with a portion of the wellbore downhole of the junk collector.

In some implementations, the tubular wall of the second tube defines apertures that fluidically couple the interior volume with an annulus defined between an exterior surface of the second tube and a wall of the wellbore. In some implementations, the apertures are distributed along a length of the tubular wall and include a diameter of between 0.5 and 1.5 inches such that a fluidic pressure at the interior volume is substantially equal to a fluidic pressure at the annulus.

In some implementations, the second tube is affixed to the first tube by a plurality of arms residing at the interior volume.

In some implementations, the first tube has an uphole end defining a fish neck. The fish neck is threadedly coupled to the production string.

In some implementations, the first tube includes a downhole end extending beyond the second tube. The downhole end includes a mule shoe configured to guide the production string.

In some implementations, the second tube has an outer diameter that is between 0.2 and 1.5 inches less than a diameter of a wall of the wellbore to help center the production string with respect to the wellbore.

In some implementations, the second tube includes a one-piece tube and the first tube includes a one-piece tube. The first tube has a length of between 3 and 5 feet and the second tube has a length of between 7 and 9 feet.

In some implementations, the junk collector is permanently attached to the production string so that retrieving the production string retrieves the junk collector.

In some implementations, the junk collector resides downhole of a last production packer of the production string.

Implementations of the present disclosure include a junk collector that includes a mandrel and a basket. The mandrel is fluidically coupled to a production string that flows production fluid from a downhole location of a wellbore to a surface of the wellbore. The mandrel flows production fluid to the production string. The basket is coupled to and disposed outside the mandrel. The basket includes an upper rim that defines an opening that receives wellbore junk. The basket defines and an interior volume that stores the wellbore junk. The interior volume is defined between an exterior surface of the mandrel and an interior surface of the basket.

In some implementations, the basket has a downhole end defining an inwardly projecting shoulder extending from the interior surface to support the wellbore junk.

In some implementations, the mandrel has an inner diameter of between 1.5 and 4 inches to allow a rig-less operation string to pass through the mandrel.

In some implementations, the basket has an outer diameter that is between 0.2 and 1.5 inches less than a diameter of a wall of the wellbore to centralize the production string with respect to the wellbore.

Implementations of the present disclosure also include a method of collecting junk in a wellbore. The method includes coupling, to a downhole end of a production string, a junk collector. The junk collector includes a first tube coupled to the production string and a second tube coupled to and disposed outside the first tube. The second tube has an upper rim defining an open end that receives fallen junk components. The second tube defines an interior volume between an exterior surface of the first tube and an interior surface of the second tube to store the fallen junk components. The second tube has a downhole end that defines an inwardly projecting shoulder extending from the interior surface to support the junk components. The method also includes deploying, within a wellbore, the production string and the junk collector. The method also includes completing the wellbore for hydrocarbon production and then, retrieving, (for example, during a workover operation) from the wellbore, at least a portion of the production string and the junk collector to remove junk collected in the junk collector.

In some implementations, the method also includes, before retrieving the at least a portion of the production string and the junk collector, deploying, through the production string and through the junk collector, a rig-less operation string to perform a rig-less operation.

DETAILED DESCRIPTION OF THE DISCLOSURE

The present disclosure describes a magnetic junk collector attached to a downhole end of a production string. The junk collector includes an inner tube or mandrel fluidically coupled to a production string and an outer tube or basket coupled to the inner tube. The outer tube has an upper rim that defines a wide opening that receives junk fallen from the production string or the wellbore. The junk collector can be permanently attached to the production string to collect junk during production. The junk collector defines apertures along its length that fluidically couple the interior volume of the junk collector to the wellbore to help equalize the pressure between the interior volume of the junk collector and the wellbore. The outer tube has a magnetic base that attracts magnetic junk to the bottom of the collector. The junk can be collected during completion, production, or de-completion procedures.

Particular implementations of the subject matter described in this specification can be implemented so as to realize one or more of the following advantages. For example, a junk collector that is permanently attached as the last item to the production string from the time the wellbore is completed can recover fallen objects during various wellbore operations, preventing the objects from interfering during intervention or rig-less activities. The magnetic junk collector can attract magnetic junk to the interior base of the junk collector, preventing junk from sticking to an exterior surface of the junk collector. The apertures of the junk collector can help prevent a swabbing effect during de-completion by equalizing the pressure between the annulus and the collector. The apertures can also equalize the pressure to allow the production fluid to flow past the basket of the junk collector unrestricted or generally unrestricted during production. Additionally, the large diameter of the junk collector can help centralize the production string. Moreover, the permanent junk collector of the present disclosure can eliminate the need of performing additional cleaning trips (for example, Annulus Casing Debris Cleaner [AC/DC] runs). For example, in preparation for a workover operation, retrieving the production string from the wellbore also retrieves the junk collector, removing the wellbore junk to allow the workover equipment to move along the wellbore without obstruction, and without the need of deploying an additional cleaning tool typically used before workover operations.

Figure 1:
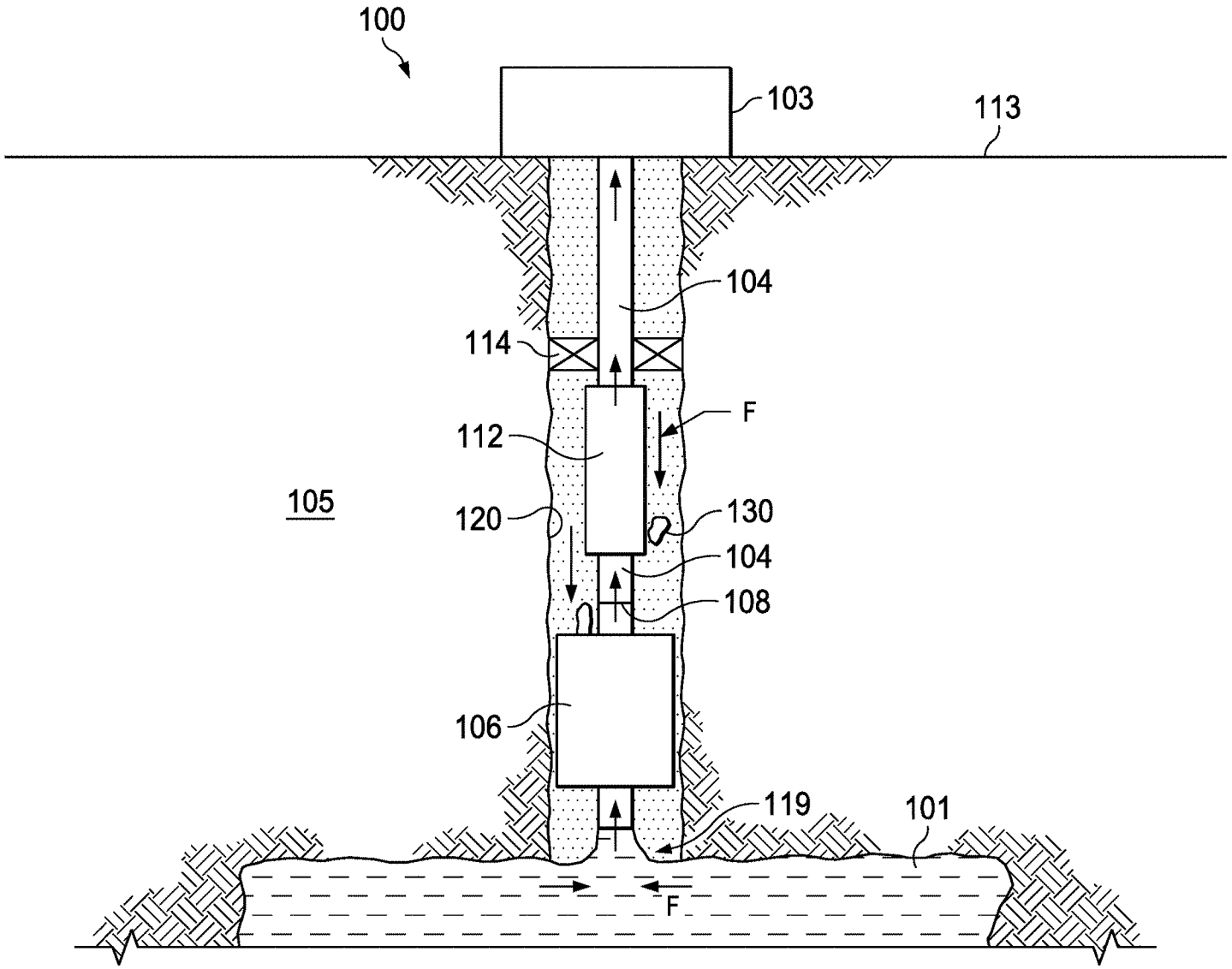
FIG. 1 is a front schematic view of a production assembly disposed in a wellbore.

FIG. 1 shows a wellbore assembly 100 with a junk collector 102 according to implementations of the present disclosure. The wellbore assembly 100 (for example, a wellbore production assembly) includes a wellhead 103, a production string 104 attached to the wellhead 103, and a junk collector 106 (for example, a cleaning sub) attached to a downhole end 108 of the production string 104. The production string 104 is disposed inside a wellbore 120 and the wellhead 103 is disposed at or near a surface 113 of the wellbore 120. The wellbore 120 is formed in a geologic formation 105 that includes a hydrocarbon reservoir 101 from which hydrocarbons can be extracted. The production string 104 flows production fluid 'F' (for example, hydrocarbons) from a downhole location 119 of the wellbore 120 to a surface 113 of the wellbore 120.

The junk collector 106 collects wellbore junk 130 fallen from the production string 104 or the wellbore 120. The wellbore junk 130 includes any components fallen from the string 104 or the wellbore 120 and may include, without limitation, packer pieces (for example, elastomer rubber), clamps or bands holding ESP cables, hand tools, remnants of milling operations, and dirt or debris from the wellbore 120.

The junk collector 106 can be permanently attached to the production string 104. For example, the junk collector 106 can be threadedly attached to the production string 104 such that retrieving the production string 104 includes retrieving the junk collector 106. The junk collector 106 can be attached to the downhole end 108 (for example, to the last component) of the production string 104. For example, the junk collector 106 can reside downhole of a last packer 114 sealing the wellbore 120 and downhole of an electric submersible pump (ESP) 112. The junk collector 106 can reside at an open hole portion of the wellbore 120 and flow production fluid 'F' from the downhole location 119 of the wellbore 120 to the production string 104. As further described in detail below with respect to FIG. 2, the production fluid 'F' stopped by the packer 114 can unrestrictedly flow downwards toward the inlet of the junk collector 106 past a basket of the junk collector 106 to enter the bottom inlet of the junk collector 106.

The junk collector 106 can be deployed within the wellbore 120 to support rig-less operations (for example, operations performed using rig-less operation strings such as coil tubing, E-line, or slick line). For example, the junk collector 106 collects wellbore junk 130 (for example, junk components) during production that would otherwise pile up at a lower completion location 119 of the wellbore 120 (for example, at the open hole portion of the wellbore) and obstruct the flow of production fluid and prevent equipment from moving along the wellbore 120. For instance, without a junk collector, junk built downhole of the production string would otherwise obstructs the path of an E-line or a slick line during rig-less operations, in which case a rig operation would be required to push or otherwise remove the junk. With the junk collector in place, the rig-less operation string can be deployed through the production string 104 and through the junk collector 106 to a location downhole of the junk collector 106 to perform the rig-less operation.

The junk collector 106 can also receive junk (for example, packer components) that fall from the production string 104 before and during a workover operation. For example, during a workover operation, the production string 104 is pulled up to brake or disengage the packer 114. As further described in detail below with respect to FIG. 2, the diameter of the junk collector 106 is similar to the outer diameter of the packer 114 to receive all of the broken components of the packer 114. Thus, the junk collector 106 collects junk that falls during the workover operation and junk that falls as the production string 104 is pulled out of the wellbore 120. Collecting the wellbore junk 130 when retrieving the production string 104 eliminates the need of an additional cleaning run typically done before deploying the workover equipment.

The ESP 112 of the production string 104 can reside downhole or uphole of the packer 114. The ESP 112 is fluidically coupled to the junk collector 106 to flow the production fluid 'F' from the reservoir 101, through the junk collector 106, to the production string 104.

Figure 2:
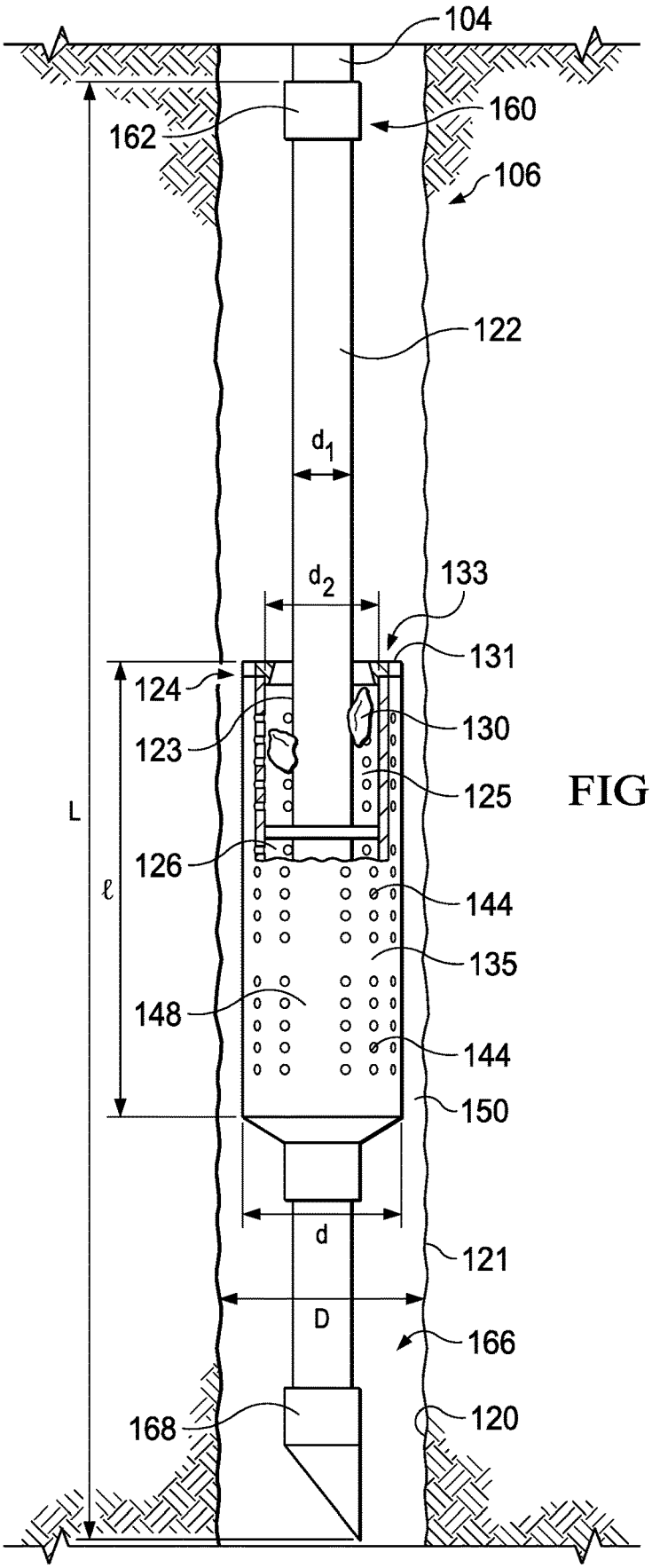
FIG. 2 is a front perspective view, partially cross-sectional, of a junk collector disposed in a wellbore.

Referring to FIG. 2, the junk collector 106 includes a first tube 122 (for example, an inner tube or mandrel) threadedly attached to the production string 104 and a second tube 124 (for example, an outer tube or basket) coupled to and disposed outside the first tube 122. The second tube 124 defines an interior volume 126 or annulus defined between an exterior surface 123 of the first tube 122 and an interior surface 125 of the second tube 124. The junk collector 106 stores the fallen wellbore junk 130 in the interior volume 126.

The second tube 124 has an upper rim 131 and a tubular wall 135 that extends from the upper rim 131. The upper rim 131 defines a wide opening 133 that has the same or substantially the same inner diameter than the tubular wall 135. The inner diameter of the upper rim 131 (and by extension the inner diameter of the second tube 124) is wide enough to receive the wellbore junk 130 and allow the wellbore junk 130 to pile up from the bottom of the junk collector 106. For example, the first tube 122 can have an outer diameter '$d_1$' of between 2 and 3.5 inches (for example, 2.875 inches) and the upper rim 131 can have an inner diameter '$d_2$' of between 7 and 8 inches (for example, 7.5 inches). The diameter of the upper rim 131 varies based on the diameter of the casing of the wellbore 120.

The first tube 122 can include a downhole end 166 that has a mule shoe 168 that guides the production string 104 during deployment within the wellbore 120. The mule shoe 168 includes a fluid inlet 169 through which production fluid enters the first tube 122 to flow toward the production string 104. The downhole end 166 of the first tube 122 can receive production fluid that flows through the first tube 122 to the production string 104. The first tube 122 can include an uphole end 160 that includes a fish neck 162. The fish neck 162 (and by extension, the junk collector 106) is permanently coupled to the production string 104. The fish neck 162 allows a fishing tool to retrieve the junk collector 106 from the wellbore 120 in a case in which the junk collector 106 brakes from the production string 104. The first tube 122 can be a one-piece tube to eliminate or reduce weak points along the first tube 122. The first tube 122 can have a length 'L' of between 7 and 9 feet (for example, 8 feet) and the second tube 124 can have a length 'l' of between 3 and 5 feet (for example, 4 feet).

The second tube 124 can act as a centralizer of the production string 104. For example, the second tube 124 can have an outer diameter 'd' that is between 0.2 and 1.5 inches (for example, 0.5 or 1 inch) less than a diameter 'D' of a wall 121 of the wellbore 120. For instance, the second tube 124 can have an outer diameter 'd' of between 8 and 9 inches (for example, 8.3 inches) and the wall 121 of the wellbore 120 can have a diameter 'D' of between 8.5 and 10 inches (for example, 8.8 inches). Thus, the clearance between the outer surface 148 of the second tube 124 and the wall 121 of the wellbore 120 can be around 0.5 inches so that the opening 133 of the junk collector 106 spans most of the diameter 'D' of the wellbore 120. The diameter of the junk collector can be similar to the outside diameter (OD) of the production packer 114 (see FIG. 1), since the packer 114 has the largest OD of the completion string components. The small gap or annulus 150 between the outer surface 148 and the wellbore 120 allows the second tube 124 to act as a centralizer of the production string 104 with respect to a central axis of the wellbore 120 and helps prevent junk 130 from falling outside the junk collector 106.

The second tube 124 defines multiple apertures 144 distributed along the length 'l' of the second tube 124. The apertures 144 are distributed along the tubular wall 135 of the second tube 124. The number of apertures per square foot of the second tube 124 can be based on the fluid weight of the production fluid. The apertures 144 have a diameter of between 0.5 and 1.5 inches (for example, 1 inch) to equalize a fluidic pressure of the interior volume 126 with a fluidic pressure of the annulus 150. The annulus 150 can be defined between the exterior surface 148 of the second tube 124 and the wall 121 of the wellbore 120. The fluidic pressure of the interior volume 126 can be equal or substantially equal to a fluidic pressure at the annulus 150 (for example, during production). For example, the apertures 144 can have a large and constant cross-section (or diameter) that defines a fluid pathway in which production fluid (for example, hydrocarbons with debris) flows at a constant or generally constant fluid pressure to prevent fluid from significantly changing in pressure between the annulus 150 and the interior volume 126. In other words, the apertures 144 are wide enough to allow the production fluid to flow from the packer 144 (see FIG. 1) to the inlet 169 without changing or substantially changing the pressure of the production fluid as the production fluid flows from the interior volume 126 to the annulus 150 or out the second tube 124 through the base of the second tube. The apertures 144 can also help prevent the swabbing effect during de-completion by equalizing the pressure between the annulus 150 and the junk collector 10.

Figure 3:
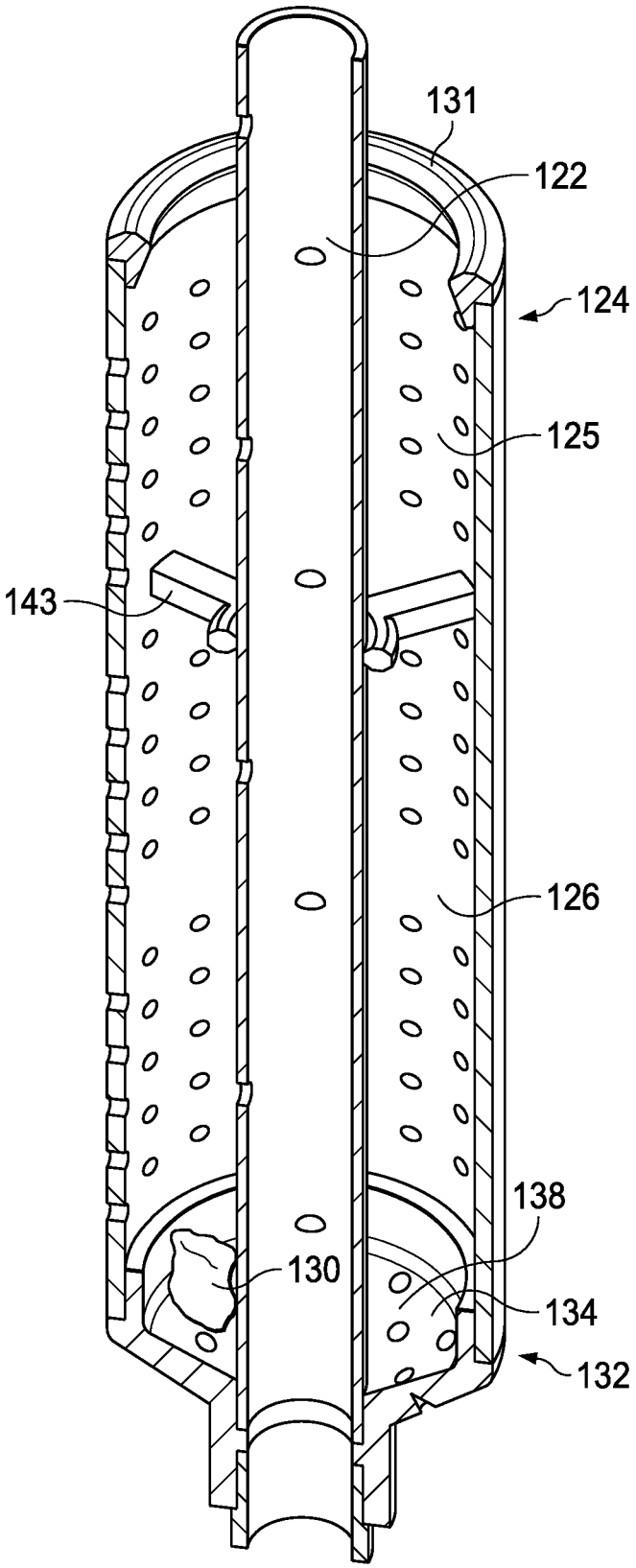
FIG. 3 is a front cross-sectional view of a portion of the junk collector of FIG. 2.
Figure 4:
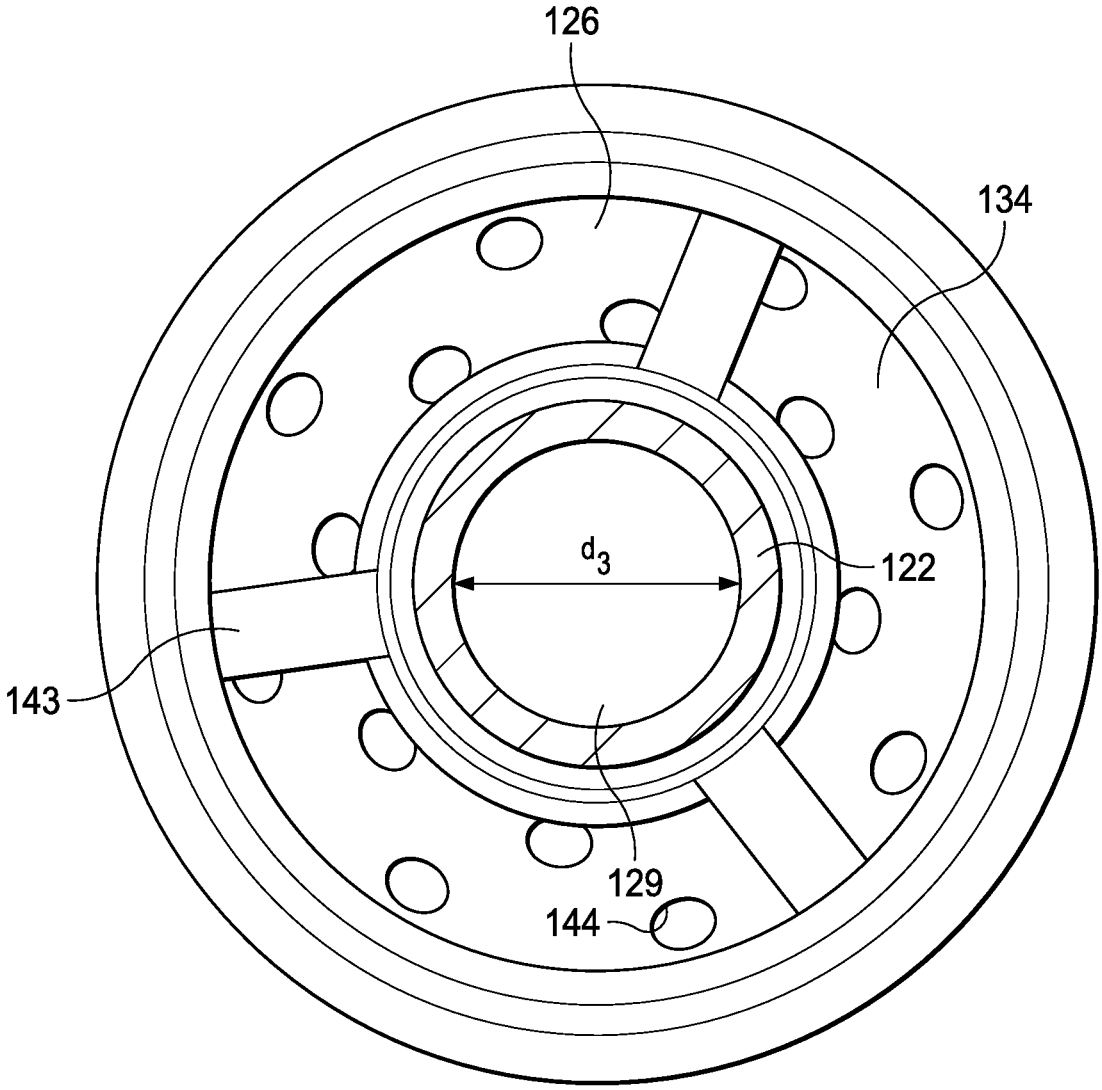
FIG. 4 is a top cross-sectional view of the junk collector of FIG. 2.

Referring to FIGS. 3 and 4, the second tube 124 has a downhole end 132 that defines an inwardly projecting shoulder or base 134. The inwardly projecting shoulder 134 extends from the interior surface 125 of the second tube 124 to the exterior surface 123 of the first tube 122. The inwardly projecting shoulder 134 can be threadedly coupled to the first tube 122 and welded to the second tube 124. Additionally, the second tube 124 can be attached to the first tube 122 by multiple arms 143 that reside at the interior volume 126. The shoulder 134 supports the wellbore junk 130 that is stored or collected in the interior volume 126 of the junk collector 106. The shoulder 134 can be made of or include a magnetic metal 138 (for example, a magnetic layer) that attracts at least some of the wellbore junk 130. The shoulder 134 can also include apertures 144 that fluidically coupled the wellbore 120 (for example, a portion of the wellbore 120 downhole of the second tube 124) to the interior volume 126 of the junk collector 106.

In some implementations, at least 50% of the area of the interior surface of the base of 134 includes or is made of a magnetic metal 138. For example, the base 134 can be made of a magnetic metal or include a magnetic layer or wall that attracts metals to the bottom of the junk collector. In some examples, the exterior surface 148 of the second tube 124 can include a non-magnetic wall to help avoid the exterior surface 148 from attracting metals.

As shown in FIG. 4, the first tube has a bore 129 fluidically decoupled (for example, the firsts tube 122 does not have apertures along its length) from the interior volume 126 of the junk collector 106. The second tube 124 can be welded to the first tube 122 through arms 143 that are designed to support the second tube but thin enough to avoid obstructing junk from reaching the bottom of the junk collector. The bore 129 flows production fluid to the production string 104 and has an inner diameter '$d_3$' of between 1.5 and 4 inches (for example, 2.4 inches) to allow a slick line or coil tubing to pass through.

Figure 5:
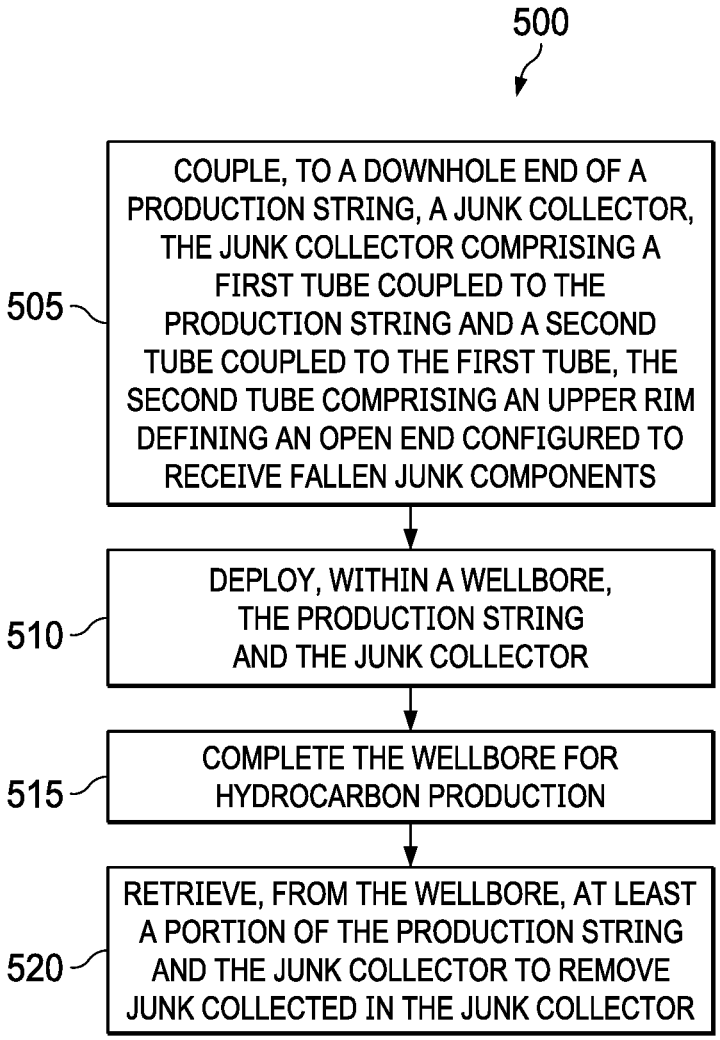
FIG. 5 is a flow chart of an example method of collecting wellbore junk.

FIG. 5 shows a flow chart of a method 500 of collecting junk in a wellbore. The method includes coupling, to a downhole end of production string, a junk collector (for example, the junk collector 106 shown in FIG. 1). The junk collector includes a first tube coupled to the production string and a second tube coupled to the first tube. The second tube has an upper rim defining an open end configured to receive fallen junk components (505). The method also includes deploying, within a wellbore, the production string and the junk collector (510). The method also includes completing the wellbore for hydrocarbon production (515), and retrieving, from the wellbore, at least a portion of the production string and the junk collector to remove junk collected in the junk collector (520).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A wellbore assembly comprising:

a production string configured to be disposed inside a wellbore, the production string configured to flow production fluid from a downhole location within the wellbore to a surface of the wellbore; and a junk collector coupled to a downhole end of the production string, the junk collector comprising a first tube fluidically coupled to the production string, the first tube configured to flow the production fluid to the production string, and a second tube coupled to and disposed outside the first tube, the second tube comprising an upper rim and a tubular wall extending from the upper rim, the upper rim defining an opening configured to receive the wellbore junk, the second tube comprising an interior volume defined between an exterior surface of the first tube and an interior surface of the tubular wall of the second tube and configured to store wellbore junk, the second tube comprising a downhole end defining an inwardly projecting shoulder extending from the interior surface and configured to support the wellbore junk, at least half of an area of the inwardly projecting shoulder comprises a magnet, the inwardly projecting shoulder defining apertures fluidically coupling the interior volume with a portion of the wellbore downhole of the junk collector, the junk collector configured to:

receive wellbore junk through the upper rim and support the wellbore junk at a downhole end of the junk collector, and store the wellbore junk.

2. The wellbore assembly of claim 1, wherein the magnet is configured to attract at least some components of the wellbore junk into the junk collector.

3. The wellbore assembly of claim 1, wherein the tubular wall of the second tube defines apertures configured to fluidically couple the interior volume with an annulus defined between an exterior surface of the second tube and a wall of the wellbore.

4. The wellbore assembly of claim 3, wherein the apertures are distributed along a length of the tubular wall and comprise a diameter of between 0.5 and 1.5 inches such that a fluidic pressure at the interior volume is substantially equal to a fluidic pressure at the annulus.

5. The wellbore assembly of claim 1, wherein the second tube is affixed to the first tube by a plurality of arms residing at the interior volume.

6. The wellbore assembly of claim 1, wherein the first tube comprises an uphole end defining a fish neck, the fish neck threadedly coupled to the production string.

7. The wellbore assembly of claim 1, wherein the first tube comprises a downhole end extending beyond the second tube and comprising a mule shoe configured to guide the production string.

8. The wellbore assembly of claim 1, wherein the second tube comprises a one-piece tube and wherein the first tube comprises a one-piece tube, the first tube comprising a length of between 3 and 5 feet and the second tube comprising a length of between 7 and 9 feet.

9. The wellbore assembly of claim 1, wherein the junk collector is permanently attached to the production string such that retrieving the production string comprises retrieving the junk collector.

10. The wellbore assembly of claim 1, wherein the junk collector resides downhole of a last production packer of the production string.

11. A junk collector comprising:

a mandrel configured to be fluidically coupled to a production string configured to flow production fluid from a downhole location of a wellbore to a surface of the wellbore, the mandrel configured to flow production fluid to the production string, the mandrel defining an inner diameter of between 1.5 and 4 inches to allow a rig-less operation string to pass through the mandrel; and a basket coupled to and disposed outside the mandrel, the basket comprising an upper rim defining an opening configured to receive wellbore junk and an interior volume configured to store the wellbore junk, the interior volume defined between an exterior surface of the mandrel and an interior surface of the basket.

12. The junk collector of claim 11, wherein the basket comprises a downhole end defining an inwardly projecting shoulder extending from the interior surface and configured to support the wellbore junk.

13. A method comprising:

coupling, to a downhole end of a production string, a junk collector, the junk collector comprising a first tube coupled to the production string and a second tube coupled to and disposed outside the first tube, the second tube comprising an upper rim defining an open end configured to receive fallen junk components and defining an interior volume between an exterior surface of the first tube and an interior surface of the second tube to store the fallen junk components, the second tube comprising a downhole end defining an inwardly projecting shoulder extending from the interior surface to support the junk components;

deploying, within a wellbore, the production string and the junk collector;

completing the wellbore for hydrocarbon production;

deploying, through the production string and through the junk collector, a rig-less operation string to perform a rig-less operation; and retrieving, from the wellbore, at least a portion of the production string and the junk collector to remove junk collected in the junk collector.

* * * * *